US009439004B2

(12) United States Patent
Luo et al.

(10) Patent No.: US 9,439,004 B2
(45) Date of Patent: Sep. 6, 2016

(54) METHOD FOR OPERATING A BINAURAL HEARING SYSTEM AND A BINAURAL HEARING SYSTEM

(75) Inventors: Henry Luo, Waterloo (CA); Ara Talaslian, Cambridge (CA); Shawn Lee, Kitchener (CA); Deming Zhang, Waterloo (CA)

(73) Assignee: SONOVA AG, Staefa (CH)

( * ) Notice: Subject to any disclaimer, the term of this patent is extended or adjusted under 35 U.S.C. 154(b) by 127 days.

(21) Appl. No.: 14/378,785

(22) PCT Filed: Feb. 22, 2012

(86) PCT No.: PCT/EP2012/052996

§ 371 (c)(1),
(2), (4) Date: Aug. 14, 2014

(87) PCT Pub. No.: WO2013/123984

PCT Pub. Date: Aug. 29, 2013

(65) Prior Publication Data

US 2015/0030162 A1 Jan. 29, 2015

(51) Int. Cl.
*H04R 5/00* (2006.01)
*H04R 25/00* (2006.01)

(52) U.S. Cl.
CPC ..... *H04R 25/552* (2013.01); *H04R 25/407* (2013.01); *H04R 2225/39* (2013.01); *H04R 2225/41* (2013.01); *H04R 2225/61* (2013.01); *H04R 2460/03* (2013.01)

(58) Field of Classification Search
None
See application file for complete search history.

(56) References Cited

U.S. PATENT DOCUMENTS

| | | | | |
|---|---|---|---|---|
| 5,604,812 | A | 2/1997 | Meyer | |
| 6,768,802 | B1 | 7/2004 | Baechler | |
| 7,773,763 | B2 | 8/2010 | Pedersen | |
| 2009/0052707 | A1 | 2/2009 | Hain | |
| 2009/0304187 | A1* | 12/2009 | Dittberner | H04R 25/40 381/23.1 |
| 2010/0002887 | A1 | 1/2010 | Roeck | |
| 2014/0307903 | A1* | 10/2014 | Fichtl | H04R 25/552 381/315 |

OTHER PUBLICATIONS

International Search Report issued in Application No. PCT/EP2012/052996 dated Oct. 18, 2012.
Written Opinion issued in Application No. PCT/EP2012/052996 dated Oct. 18, 2012.

* cited by examiner

*Primary Examiner* — Muhammad N Edun
(74) *Attorney, Agent, or Firm* — Pearne & Gordon LLP

(57) ABSTRACT

A method for operating a binaural hearing system including first and second hearing devices, each including an input transducer, a signal processing unit, an output transducer and a link unit for exchanging information between the devices. Operating the first hearing device according to a first processing scheme, operating the second hearing device according to a second processing scheme, monitoring an acoustic situation by the hearing devices, generating a request for coordinating the two hearing devices if one hearing device detects an acoustic situation asking for coordinating the two processing schemes of the hearing devices, the hearing device detecting such an acoustic situation being an ipsilateral hearing device the other being a contra-lateral hearing device, activating a link between the devices for transmitting the request to the contra-lateral hearing device, and changing the processing scheme in at least one of the devices in accordance with the request.

16 Claims, 2 Drawing Sheets

METHOD FOR OPERATING A BINAURAL HEARING SYSTEM AND A BINAURAL HEARING SYSTEM

FIELD OF THE INVENTION

The present invention is related to a method for operating a binaural hearing system comprising two hearing devices and to a binaural hearing system.

BACKGROUND OF THE INVENTION

A binaural hearing system comprises two hearing devices which are interconnected in order to exchange information, such as information with regard to the acoustic situation. The exchange of information results in a coordination of the two hearing devices resulting in improved overall performance of the binaural hearing system. For different acoustic situations, for various target speech levels and for positions, it is beneficial to apply optimized adaptive processing strategies. In many acoustic situations, such as clean speech, extremely noisy environments or target speech not at the front, it is desired to apply more independent signal processing on each individual hearing device of the binaural hearing system. In many difficult acoustic situations—such as when a target speech is in the front with a noisy background—, better performance can be obtained by applying more symmetrical signal processing. For any binaural hearing system, power consumption for a link between the two hearing devices is an important limiting factor.

Known binaural hearing systems are described, for example, in U.S. Pat. Nos. 5,604,812, 6,768,802 B1, US 2010/0002887 A1, and U.S. Pat. No. 7,773,763. While the teaching according to U.S. Pat. No. 5,604,812 discloses no information exchange between the hearing devices, resulting in undefined states and therefore leading to discomfort of the binaural hearing system user, the other known solutions have the drawback that a continuous information exchange takes place between the two hearing devices of the binaural hearing system resulting in rather high power consumption.

It is therefore an object of the present invention to provide a binaural hearing system that at least overcomes the above-mentioned drawback.

SUMMARY OF THE INVENTION

First, the present invention is directed to a method for operating a binaural hearing system comprising a first and a second hearing device, each comprising at least one input transducer, a signal processing unit, an output transducer and a link unit capable for exchanging information between the first and the second hearing device. The method according to the present invention comprises the steps of:

- operating the first hearing device according to a first processing scheme,
- operating the second hearing device according to a second processing scheme,
- monitoring acoustic situation by the first hearing device,
- monitoring acoustic situation by the second hearing device,
- generating a request for coordinating the two hearing devices if one hearing device detects an acoustic situation asking for coordinating the two processing schemes of the first and the second hearing device, the hearing device detecting such an acoustic situation being an ipsi-lateral hearing device the other being a contra-lateral hearing device,

- activating a link between the ipsi-lateral hearing device and the contra-lateral hearing device for transmitting the request to the contra-lateral hearing device, and
- changing the processing scheme in at least one of the ipsi-lateral hearing device and the contra-lateral hearing device in accordance with the request.

The terms "contra-lateral" and "ipsi-lateral" are used in connection with the hearing devices through this description. For example, information pertaining to the ipsi-lateral hearing device is information of the hearing devices being looked at, whereas the other hearing device is called the contra-lateral hearing device. Thus, depending on the point of view, either the left or the right hearing device can be the ipsi-lateral hearing device, the other being the contra-lateral hearing device.

It is pointed out that the hearing devices of the binaural hearing system are generally operated according to their processing schemes which mean that no information exchange takes place between the hearing devices. A connection via the link is only established if a certain acoustic situation occurs that asks for a so called binaural control. After an exchange of information between the hearing devices has been completed the link is shut down in order to save power.

An embodiment of the present invention comprises the step of changing the processing scheme in the ipsi-lateral hearing device based on the acoustic situation monitored in the contralateral hearing device.

Further embodiments of the present invention comprise the step of changing the processing scheme in the ipsi-lateral hearing device further based on the acoustic situation monitored in the ipsi-lateral hearing device.

Still further embodiments of the present invention comprise the step of changing the processing scheme in the contra-lateral hearing device based on the acoustic situation monitored in the ipsi-lateral hearing device.

Still further embodiments of the present invention comprise the step of changing the processing scheme in the contra-lateral hearing device (1, 2) further based on the acoustic situation monitored in the contra-lateral hearing device.

Still further embodiments of the present invention comprise the steps of:

- processing the request in the contra-lateral hearing device taking into account information available in the contralateral hearing device,
- either confirming the request by the contra-lateral hearing device or rejecting the request by the contra-lateral hearing device by transmitting corresponding information to the ipsi-lateral hearing device.

In further embodiments of the present invention, the acoustic situation is characterized by at least one of the following:

- an input signal picked-up by an input transducer;
- a user input signal;
- a target sensor signal.

Still further embodiments of the present invention comprise the step of pre-processing the acoustic situation before generating a request in order to reduce a request rate to a predetermined rate.

Second, the present invention is also directed to a binaural hearing system comprising a first hearing device and a second hearing device. Each hearing device comprises:

- at least one input transducer,
- a signal processing unit,
- an output transducer, a link unit capable for exchanging information between the hearing devices, means for monitoring acoustic situation, means for generating a request if an acoustic situation is detected asking for exchanging information between the hearing devices, the hearing device detecting such an acoustic situation being an ipsi-lateral hearing device the other being a contra-lateral hearing device, means for activating a link between the ipsi-lateral hearing device and the contra-lateral hearing device for transmitting the request to the contra-lateral hearing device, and means for changing the processing scheme in at least one of the ipsi-lateral hearing device and the contra-lateral hearing device in accordance with the request.

In embodiments of the binaural hearing system according to the present invention, the means for changing the processing scheme in the ipsi-lateral hearing device is taking into account the acoustic situation monitored in the contra-lateral hearing device.

In further embodiments of the binaural hearing system according to the present invention, the means for changing the processing scheme in the ipsi-lateral hearing device is further taking into account the acoustic situation monitored in the ipsi-lateral hearing device.

In still further embodiments of the binaural hearing system according to the present invention, the means for changing the processing scheme in the contra-lateral hearing device is taking into account the acoustic situation monitored in the ipsi-lateral hearing device.

In further embodiments of the binaural hearing system according to the present invention, the means for changing the processing scheme in the contra-lateral hearing device is further taking into account the acoustic situation monitored in the contra-lateral hearing device.

Further embodiments of the binaural hearing system according to the present invention further comprise:

means for processing the request in the contra-lateral hearing device taking into account information available in the contra-lateral hearing device, means for either confirming the request by the contra-lateral hearing device or means for rejecting the request by the contra-lateral hearing device by transmitting corresponding information to the ipsi-lateral hearing device.

In further embodiments of the binaural hearing system according to the present invention, the acoustic situation is characterized by at least one of the following:

an input signal picked-up by an input transducer;

a user input signal;

a target sensor signal.

Further embodiments of the binaural hearing system according to the present invention further comprise means for pre-processing the acoustic situation before generating a request in order to reduce a request rate to a predetermined rate.

BRIEF DESCRIPTION OF THE DRAWINGS

The present invention is further explained in more detail by referring to drawings illustrating exemplified embodiments of the present invention.

DETAILED DESCRIPTION OF THE INVENTION

Figure 1:
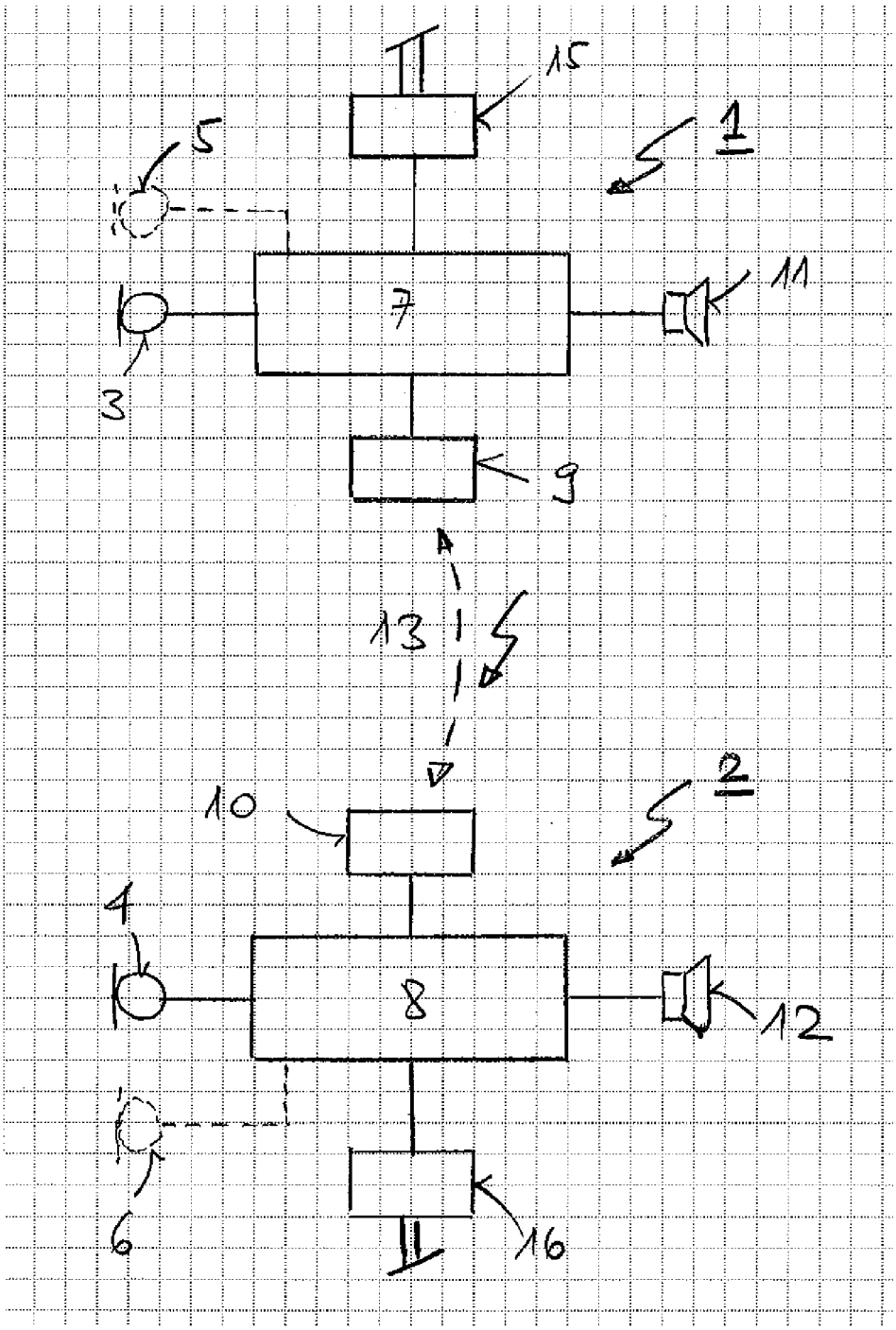
FIG. 1 schematically shows a block diagram of a binaural hearing system comprising two hearing devices.

FIG. 1 shows a block diagram of a binaural hearing system comprising two hearing devices 1 and 2 that are operatively interconnected via a link 13. For example, the link 13 may either be a wireless link or a wired link. A first link unit 9 is provided in one hearing device 1 while a second link unit 10 is provided in the other hearing device 2, the first and the second link units 9 and 10 being able to initiate, maintain and interrupt or conclude an interconnection between the hearing devices 1 and 2 via the link 13.

Each of the hearing devices 1 and 2 comprises at least one input transducer 3 or 4, respectively. Additional input transducers may also be provided, such as it is depicted in FIG. 1 showing a further input transducer 5 comprised in the first hearing device 1 and showing a further input transducer 6 comprised in the second hearing device 2, the further input transducers 5 and 6 being represented by dashed lines. In case a hearing device 1, 2 comprises two input transducers, a so called beam former can be realized without necessarily relying on input transducers of the other hearing device of the binaural hearing system. This is in particular important if the hearing devices 1, 2 are run autonomously, i.e. without exchanging information between the hearing devices 1 and 2 via the link 13.

Furthermore, each of the hearing devices 1 and 2 comprises a digital signal processing unit 7 or 8, respectively, a output transducer 11 or 12, respectively, and, as an option, an input unit 15 or 16, respectively. The input unit 15 or 16 may be used, for example, to let a user manually control the behavior of one of the hearing devices 1 or 2, or the behavior of the entire binaural hearing system.

For example, the signal processing unit 7 or 8 is the central unit to which all other units are operatively connected as it is depicted in FIG. 1. In fact, the signal processing units 7 and 8 control the processing of input signals due to a processing scheme within a hearing device 1, 2. In addition, interaction between the hearing devices is also controlled via the corresponding signal processing unit 7 or 8 to control the entire binaural hearing system.

According to the present invention, each of the signal processing units 7 and 8 may have its own processing scheme. In fact, the hearing devices 1 and 2 may be operated independently of each other, i.e. the first hearing device 1 operating according to a first processing scheme, and the second hearing device 2 operating according to a second processing scheme. Whenever the acoustic situation changes in a way that adjustments must be made to the processing schemes of the binaural hearing system, the link 13 between the hearing devices 1 and 2 is activated. Thereto, the acoustic situation is monitored by the first hearing device 1 as well as by the second hearing device 2. A request for coordinating the two hearing devices 1 and 2 is generated if one hearing device 1 or 2 detects an acoustic situation asking for coordinating the two processing schemes of the first and the second hearing device 1, 2. In this connection, the hearing device in which such an acoustic situation is detected is called ipsi-lateral hearing device. The other hearing device is then called contra-lateral hearing device. It is the ipsi-lateral hearing device that activates the link 13 to the contra-lateral hearing device for transmitting a request to the contra-lateral hearing device. Subsequently, the processing scheme is changed in at least one of the ipsi-lateral hearing device and the contra-lateral hearing device in accordance with the request.

It is pointed out that changing a processing scheme may be performed in at least one of the following manners:

changing the processing scheme in the ipsi-lateral hearing device based on the acoustic situation monitored in the contra-lateral hearing device;

changing the processing scheme in the ipsi-lateral hearing device based on the acoustic situation monitored in the ipsi-lateral hearing device;

changing the processing scheme in the contra-lateral hearing device based on the acoustic situation monitored in the ipsi-lateral hearing device;

changing the processing scheme in the contra-lateral hearing device base on the acoustic situation monitored in the contra-lateral hearing device.

According to the present invention, the link 13 between the hearing devices 1 and 2 is only activated if the step of monitoring the acoustic situation leads to the conclusion that a processing scheme in one of the hearing devices 1, 2 must be adjusted. As a result, the link 13 is only active if necessary which is advantageous regarding energy consumption. In fact, the binaural hearing system according to the present invention comprises two intelligent sub-systems, namely the hearing devices 1 and 2, that are coordinated together as an overall binaural hearing system.

The architecture according to the present invention is in particular advantageous in that a smart wireless communication between the hearing devices 1, 2 is provided with extremely low power consumption. In addition, the hearing devices 1, 2 comprise intelligent environment and target detection systems running in real-time with dynamic acoustic environment detection. Continuous monitoring and detection of target and environment change will not be exchanged between the hearing devices 1 and 2. Only when the decision to have a change is required in either hearing device of the binaural hearing system, an adaptively binaural communication request will be generated, which results in a very efficient and intelligent way to get further processing benefit. There is no need for continuous communication between the two hearing devices 1 and 2.

In a further embodiment of the present invention, the present acoustic situation is pre-processed before generating a request for the contra-lateral hearing device to change its state in order to reduce a request rate to a predetermined rate. Thereto, a history of detected acoustic situation is logged in the binaural hearing system. The logged history can be used in a self-learning algorithm to improve the detection of a particular acoustic situation in the future.

The binaural hearing system according to the present invention is able to detect a speech target as well as an overall acoustic situation and other input as, for example, from a user preference control unit or the like.

With the binaural hearing system enabled, the two hearing devices 1 and 2 work as fully automatic and independent hearing devices that synchronize only when necessary. For example, the binaural hearing system enables the signals of all four input transducers 3 to 6 present in a pair of hearing devices 1, 2 within various acoustic situations to produce superior hearing performance, with low power consumption.

Binaural hearing system detectors present on both sides (i.e. in both hearing devices 1 and 2) can detect the acoustic situation and a speech target in real-time. With this capability the binaural hearing system addresses and solves four critical technical challenges:

reliable and intelligent detection of a speech target;

intelligent decision on each hearing device 1, 2 independently;

fully automatic binaural hearing system control; and low power consumption.

The binaural hearing system detectors detect the acoustic situation and speech target, for example, through monitoring at least one of the following input signals:

acoustic environment sensor;

user preference sensor; and speech target sensor.

In order to minimize power consumption of the hearing devices 1 and 2 and retain the strength and benefit of known binaural hearing systems, the link 13 is defaulted to off and the hearing devices 1 and 2 work independently most of the time. When the binaural hearing system detector on either side has not identified the necessary acoustic situation change, the binaural hearing system will remain in the current mode.

Hence, the link 13 will be on or off dynamically according to the real-time detection by the binaural hearing system detectors, i.e. the detectors of the hearing devices 1 and 2.

When one hearing device 1 or 2 identifies an acoustic situation change requiring different adaptive processing, the link 13 will be enabled for information exchange. According to one embodiment of the present invention, a binaural control will be updated when both hearing devices 1 and 2 agree with the new processing request. In this way, we have an intelligent binaural hearing system without keeping the link 13 on all the time.

Figure 2:
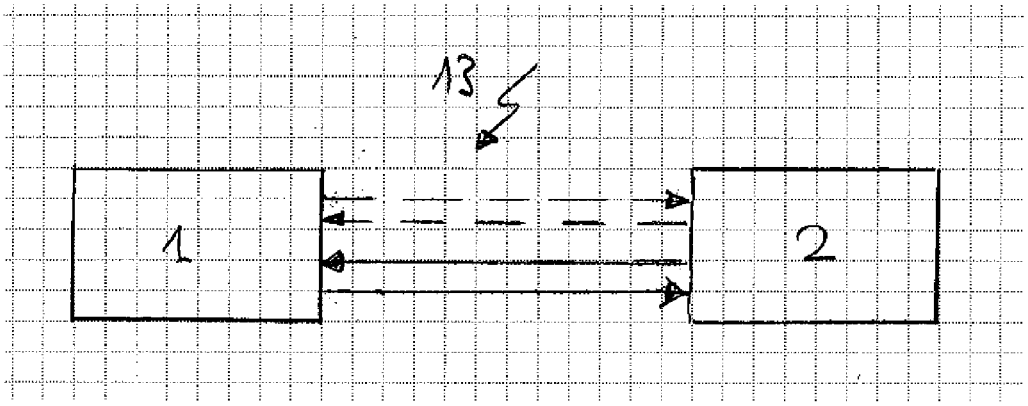
FIG. 2 shows the two hearing devices as blocks illustrating interaction via a link.

This basic principle is again illustrated in FIG. 2, in which a block diagram comprising the hearing devices 1 and 2 is depicted. As has already been mentioned above, the two hearing devices 1 and 2 are independent sub-systems with real-time detection and decision capabilities. Furthermore, the link 13 is only active if a request for information exchange or state change is generated by one of the two hearing devices 1 or 2. Therefore, the link 13 is generally not active.

A request for information exchange or state change can be generated by either hearing device 1 or 2. In case the first hearing device 1 detects an acoustic situation asking for an information exchange between the two hearing devices 1 and 2 (or asking for a state change in one or in both hearing devices 1 and 2), a request is sent from the first hearing device 1 to the second hearing device 2. In one embodiment, the request suffices in order to start the information exchange/state change. In another embodiment of the present invention, the second hearing device 2 determines whether to agree or disagree with the information exchange/state change. In other words, the contra-lateral hearing device 2 (the hearing devices which receives the request) has the decision capability to either confirm the request for the state change or reject the request according to its own detection and rule in place for switching. In the affirmative—i.e. if a state change and/or an information exchange are accepted—, the second hearing device 2 generates a confirming message to the first hearing device 1 via the link 13. If the request is rejected by the second hearing device 2, no information exchange or state change will take place. The flow of the request and confirmation messages starting by the first hearing device 1 is illustrated by dashed lines in FIG. 2.

Similarly, the flow of a request and confirmation messages starting by the second hearing device 2 is illustrated by a solid line in FIG. 2.

Having said the above, it is again emphasized to keep in mind that the binaural hearing system according to the invention comprises two independent hearing devices 1 and 2 that are synchronized only when necessary. This results in a very efficient and intelligent binaural hearing system. It has been found out that the binaural hearing system according to the present invention has all the advantages of known binaural hearing systems but still consumes less power. Compared with a standard monaural hearing device, a hearing device of the binaural hearing system according to the present invention consumes only 5 to maximal 10% additional power.

In a further embodiment of the present invention, additional input transducers are used to detect acoustic situation variations and target variations to keep the binaural hearing system from frequently switching from one state to another state. In this connection, it has already been proposed to use a data logging facility in order to log information regarding detected acoustic situations as a function of captured signals by the additional input transducers.

With the knowledge of the acoustic situation and/or target source, different signal processing technologies such as signal enhancement, noise reduction, static beam former, adaptive beam former, broadband gain, narrow band gain, audio-streaming, binaural beam former can be activated or deactivated in real-time in order to increase and optimize the performance of the binaural hearing system.

Based on the combination of the input transducers or detectors, the binaural hearing system according to the present invention can potentially do the following:

- For an acoustic situation only comprising speech: switch to omni-direction without enabling signal enhancement, noise reduction or gain adjustment for a neutral perception;
- For an acoustic situation comprising only noise: switch to monaural mode to suppress noise for comfort perception and disable signal enhancement;
- For an acoustic situation comprising speech in noise: in addition to enabling signal enhancement and noise reduction, further decision can be made as a function of the position of the target sound source:
  - Target is in the front: enhance one or more features such as static beam former, adaptive beam former, or spectrum adjustment.
  - Target is on side: keep two hearing devices work independently for each side or streaming the target sound source from the same side to the opposite side (to the contra-lateral hearing device) with a mixture of the signal of the ipsi-lateral hearing device;
  - Target is on rear: reverse the beam former to suppress the noise from the front (or around) and focus on the target sound source from the rear;
- Steering the beam former to point to the target sound source while maximally suppress the noise surrounding.
- Steering the binaural beam former to point to the target sound source to further focus on target sound source and suppress noise in certain acoustic situations.

The architecture according to the present invention allows binaural hearing systems to intelligently integrate via a wireless connection using extremely low-power consumption, by only having the wireless link active when necessary and not active the rest of the time.

Furthermore, a further embodiment of the binaural hearing system according to the present invention will remember the acoustic situation and only apply the adaptive binaural processing scheme to the identical or similar acoustic situation, even through the acoustic situation may change dramatically from time to time.

The binaural hearing system according to the present invention will be the first intelligent binaural hearing system with two intelligent sub-systems working independently most of time, but coordinating intelligently when necessary with the benefits of extremely low power consumption.

Having thus shown and described what is at present considered as the embodiments of the invention, it should be noted that the same has been made by way of illustration and not limitation. Accordingly, all modifications, alterations and changes coming within the spirit and scope of the invention are herein meant to be included.

What is claimed is:

1. A method for operating a binaural hearing system comprising a first and a second hearing device (1, 2), each comprising at least one input transducer (3, 4, 5, 6), a signal processing unit (7, 8), an output transducer (11, 12) and a link unit (9, 10) capable for exchanging information between the first and the second hearing device (1, 2), the method comprising the steps of:

- operating the first hearing device (1) according to a first processing scheme,
- operating the second hearing device (2) according to a second processing scheme,
- monitoring acoustic situation by the first hearing device (1),
- monitoring acoustic situation by the second hearing device (2),
- generating a request for coordinating the two hearing devices (1, 2) if one hearing device (1, 2) detects an acoustic situation asking for coordinating the two processing schemes of the first and the second hearing device (1, 2), the hearing device (1, 2) detecting such an acoustic situation being an ipsi-lateral hearing device (1, 2) the other being a contra-lateral hearing device (1, 2),
- activating a link between the ipsi-lateral hearing device (1, 2) and the contra-lateral hearing device (1, 2) for transmitting the request to the contra-lateral hearing device (1, 2),
- shutting down the link between the ipsi-lateral hearing device (1, 2) and the contra-lateral hearing device (1, 2) after the request has been transmitted to the contra-lateral hearing device (1, 2), and
- changing the processing scheme in at least one of the ipsi-lateral hearing device (1, 2) and the contra-lateral hearing device (1, 2) in accordance with the request.

2. The method of claim 1, wherein the step of changing the processing scheme in the ipsi-lateral hearing device (1, 2) is based on the acoustic situation monitored in the contra-lateral hearing device (2, 1).

3. The method of claim 2, wherein the step of changing the processing scheme in the ipsi-lateral hearing device (1, 2) is further based on the acoustic situation monitored in the ipsi-lateral hearing device (1, 2).

4. The method of claim 1, wherein the step of changing the processing scheme in the contra-lateral hearing device (1, 2) is based on the acoustic situation monitored in the ipsi-lateral hearing device (2, 1).

5. The method of claim 4, wherein the step of changing the processing scheme in the contra-lateral hearing device (1, 2) is further based on the acoustic situation monitored in the contra-lateral hearing device (1, 2).

6. The method of claim 1, further comprising the steps of:

- processing the request in the contra-lateral hearing device taking into account information available in the contra-lateral hearing device, either confirming the request by the contra-lateral hearing device or rejecting the request by the contra-lateral hearing device by transmitting corresponding information to the ipsi-lateral hearing device.

7. The method of claim 1, wherein the acoustic situation is characterized by at least one of the following:

an input signal picked-up by an input transducer (3, 4, 5, 6);

a user input signal;

a target sensor signal.

8. The method of claim 1, further comprising the step of pre-processing the acoustic situation before generating a request in order to reduce a request rate to a predetermined rate.

9. A binaural hearing system comprising a first hearing device (1) and a second hearing device (2), each hearing device (1, 2) comprising:

at least one input transducer (3, 5; 4, 6), a signal processing unit (7; 8), an output transducer (11; 12), a link unit (9; 10) capable for exchanging information between the hearing devices (1, 2), means for monitoring acoustic situation, means for generating a request if an acoustic situation is detected asking for exchanging information between the hearing devices (1, 2), the hearing device (1, 2) detecting such an acoustic situation being an ipsi-lateral hearing device (1, 2) the other being a contra-lateral hearing device (1, 2), means for activating a link between the ipsi-lateral hearing device (1, 2) and the contra-lateral hearing device (1, 2) for transmitting the request to the contra-lateral hearing device (1, 2), means for shutting down the link between the ipsi-lateral hearing device (1, 2) and the contra-lateral hearing device (1, 2) after the request has been transmitted to the contra-lateral hearing device (1, 2), and means for changing the processing scheme in at least one of the ipsi-lateral hearing device (1, 2) and the contra-lateral hearing device (1, 2) in accordance with the request.

10. The binaural hearing system of claim 9, wherein the means for changing the processing scheme in the ipsi-lateral hearing device (1, 2) is taking into account the acoustic situation monitored in the contra-lateral hearing device (2, 1).

11. The binaural hearing system of claim 10, wherein the means for changing the processing scheme in the ipsi-lateral hearing device (1, 2) is further taking into account the acoustic situation monitored in the ipsi-lateral hearing device (1, 2).

12. The binaural hearing system of claim 9, wherein the means for changing the processing scheme in the contra-lateral hearing device (1, 2) is taking into account the acoustic situation monitored in the ipsi-lateral hearing device (2, 1).

13. The binaural hearing system of claim 12, wherein the means for changing the processing scheme in the contra-lateral hearing device (1, 2) is further taking into account the acoustic situation monitored in the contra-lateral hearing device (1, 2).

14. The binaural hearing system of claim 9, further comprising:

means for processing the request in the contra-lateral hearing device taking into account information available in the contra-lateral hearing device, means for either confirming the request by the contra-lateral hearing device or means for rejecting the request by the contra-lateral hearing device by transmitting corresponding information to the ipsi-lateral hearing device.

15. The binaural hearing system of claim 9, wherein the acoustic situation is characterized by at least one of the following:

an input signal picked-up by an input transducer (3, 4, 5, 6);

a user input signal;

a target sensor signal.

16. The binaural hearing system of claim 9, further comprising means for pre-processing the acoustic situation before generating a request in order to reduce a request rate to a predetermined rate.

* * * * *